US008887959B2

(12) United States Patent
Hill et al.

(10) Patent No.: US 8,887,959 B2
(45) Date of Patent: Nov. 18, 2014

(54) SYSTEMS FOR STORING BEVERAGES

(71) Applicants: Nicholas Hill, Bend, OR (US); John Herrick, Sunriver, OR (US)

(72) Inventors: Nicholas Hill, Bend, OR (US); John Herrick, Sunriver, OR (US)

( * ) Notice: Subject to any disclaimer, the term of this patent is extended or adjusted under 35 U.S.C. 154(b) by 0 days.

(21) Appl. No.: 13/931,038

(22) Filed: Jun. 28, 2013

(65) Prior Publication Data

US 2014/0231442 A1 Aug. 21, 2014

Related U.S. Application Data

(60) Provisional application No. 61/766,048, filed on Feb. 18, 2013, provisional application No. 61/766,941, filed on Feb. 20, 2013, provisional application No. 61/766,949, filed on Feb. 20, 2013.

(51) Int. Cl.

| | |
|---|---|
| ***B67D 7/78*** | (2010.01) |
| ***A47G 19/22*** | (2006.01) |
| ***B67D 3/00*** | (2006.01) |
| ***B65D 47/32*** | (2006.01) |

(52) U.S. Cl.

CPC ..... *A47G 19/2266* (2013.01); *B67D 3/0029* (2013.01); *B65D 47/32* (2013.01); *B67D 3/0051* (2013.01)

USPC ..... 222/131; 222/386.5; 222/396; 222/400.7; 222/464.1; 222/465.1; 222/542; 222/558; 220/739; 215/396; 215/397

(58) Field of Classification Search

USPC ..... 222/131, 183, 386.5, 389, 387, 396, 222/397, 400.7, 464.1, 465.1, 542, 558; 220/737, 739–740, 758; 215/395–397

See application file for complete search history.

(56) References Cited

U.S. PATENT DOCUMENTS

| | | | | |
|---|---|---|---|---|
| 200,666 | A | 2/1878 | Outten | |
| 603,724 | A | 5/1898 | Broome | |
| 2,360,744 | A * | 10/1944 | Valkenburg et al. | 335/261 |
| 2,524,639 | A * | 10/1950 | Saunders | 294/154 |
| 2,981,562 | A | 4/1961 | Long | |
| 3,419,193 | A * | 12/1968 | Stewart et al. | 222/183 |
| 3,590,888 | A * | 7/1971 | Coleman | 141/5 |
| 3,802,470 | A * | 4/1974 | Coleman | 141/5 |
| 4,187,959 | A * | 2/1980 | Pelton | 222/94 |
| 4,372,336 | A * | 2/1983 | Cornell et al. | 137/205 |
| 4,520,950 | A * | 6/1985 | Jeans | 222/129.1 |
| 4,658,979 | A * | 4/1987 | Mietz et al. | 220/203.13 |
| 4,666,197 | A * | 5/1987 | Watson et al. | 294/31.2 |
| 4,842,158 | A | 6/1989 | Reyes, Jr. | |
| 4,982,869 | A * | 1/1991 | Robbins, III | 220/742 |
| 5,045,077 | A * | 9/1991 | Blake, III | 604/321 |
| 5,199,609 | A * | 4/1993 | Ash, Jr. | 222/94 |
| 5,944,229 | A * | 8/1999 | Rokkjaer | 222/153.07 |
| 6,241,415 | B1 | 6/2001 | Stark | |
| 6,745,922 | B1 | 6/2004 | Vlooswijk et al. | |
| 6,783,034 | B1 * | 8/2004 | Brent | 222/183 |
| 7,581,770 | B2 * | 9/2009 | Jones | 294/31.2 |

(Continued)

FOREIGN PATENT DOCUMENTS

| | | | |
|---|---|---|---|
| EP | 1140692 | A1 | 10/2001 |
| EP | 2258629 | A1 | 12/2010 |

*Primary Examiner* — Frederick C Nicolas

(74) *Attorney, Agent, or Firm* — Leber Patent Law P.C.

(57) ABSTRACT

Systems for storing beverages are disclosed, which include a container for storing, transporting and dispensing a beverage, e.g. beer. In some implementations the container includes a pressure-tight lid closure system including wire bails.

20 Claims, 17 Drawing Sheets

(56) References Cited

U.S. PATENT DOCUMENTS

| | | | | |
|---|---|---|---|---|
| D617,194 | S | 6/2010 | Jones | |
| 2007/0272651 | A1 | 11/2007 | DiPasquale | |
| 2011/0226806 | A1* | 9/2011 | O'Dougherty et al. | 222/1 |
| 2012/0312832 | A1 | 12/2012 | Lane | |
| 2014/0001205 | A1* | 1/2014 | Hodges et al. | 222/95 |

* cited by examiner

SYSTEMS FOR STORING BEVERAGES

RELATED APPLICATIONS

This application claims priority of U.S. Provisional Application Ser. No. 61/766,048, filed Feb. 18, 2013, U.S. Provisional Ser. No. 61/766,941, filed Feb. 20, 2013, and U.S. Provisional Ser. No. 61/766,949, filed on Feb. 20, 2013. The complete disclosure of each of these applications is hereby incorporated by reference herein.

BACKGROUND

Pressurized beverage containers (containers that are capable of maintaining internal pressure, e.g., from carbonation or compressed gas) are typically of single use design, e.g. a can or bottle of beer. These containers are generally constructed of glass or an aluminum alloy. Closure mechanisms range from caps, twist off or pressed, to tabs which are integrally formed with the lid or top of the vessel.

Some larger containers for carbonated beverages, e.g. kegs, while reusable, and in some cases pressurizable, are not easily transportable or easily cleaned due to their large size and valve/dispensing system.

Medium sized (e.g., 32 or 64 ounce) beer containers, commonly known as "growlers," are generally not capable of maintaining carbonation or pressurization, and thus if the entire contents are not consumed at one sitting the remaining beer will go flat.

SUMMARY

Generally, the present disclosure pertains to systems for storing and dispensing beverages. In some implementations, the systems are configured for storing carbonated beverages, and include a container capable of maintaining an internal pressure. Preferred systems also include a delivery device configured to allow a user to easily dispense a liquid from the container under pressure and/or a device configured to allow the container to be repressurized as the contents of the container are exhausted.

In one aspect, the beverage storage systems described herein include a system for storing carbonated or pressurized beverages comprising: a container having a rim defining an opening, a lid configured for sealing engagement with the rim, and a closure system comprising a pair of wire bails that are pivotably mounted on the container and configured to toggle between an open position in which the lid can be moved away from the opening, and a closed position in which the bails latch over-center causing the lid to apply a downward force to the rim.

Some implementations can include one or more of the following features. For example, the container may have a double walled metal construction. The lid could include a pair of channels configured to receive lid-retaining portions of the bails.

In some cases the container includes a neck region and the system further comprises a band fixedly mounted on the neck region and configured for pivoting attachment of the bails. The band can include apertures configured to receive the ends of the bails. In addition, the band can include features to which a handle is fixedly attached.

Some implementations of the beverage system can comprise an elastomeric seal interposed between a bottom surface of the lid and the rim of the container. Furthermore, the beverage system can feature a rim that has a non-planar surface and an elastomeric seal that has a beveled surface configured for engagement with the non-planar surface.

In another aspect, the system for storing beverages can comprise a container having a rim defining an opening, a lid configured for sealing engagement with the rim, and a closure system comprising a wire bail that is pivotably mounted on the container and configured to toggle between an open position in which the lid can be moved away from the opening, and a closed position in which the lid is sealed against the rim. In this aspect of the invention, the lid and wire bail include cooperating features configured to retain the lid on the bail when the bail is in its open position.

Furthermore, the lid can include a groove having a retention feature configured to engage a corresponding feature on the bail. In some implementations, a portion of the groove can be undercut.

In another aspect, the beverage storing system can comprise a double-walled steel container body having a rim that is arcuate in cross-section; and a closure system including a lid having a beveled seal having an angled surface configured to engage the rim.

Some implementations can include one or more of the following features. For example, the rim that is arcuate in cross-section can comprise a bend in the double-walled material. Furthermore, the seal can be formed of an elastomeric material.

In some implementations, the seal can be disposed in an angular channel in the lid. The container body can include a generally cylindrical neck region and the channel can include a sidewall configured to abut an outer surface of the neck region.

In some cases, the closure system comprises a pair of bails configured to be in an over center position in the closed position and thereby apply a downward force between the rim and the angled surface of the seal.

In another aspect of the invention, the beverage storage and dispensing system can comprise a container body, a lid having a dispensing port, a pressure relief valve, and a gas inlet valve; a tubular conduit configured to be sealingly retained in the dispensing port and extend above and below the lid; and a dispensing device at a distal end of the conduit.

Some implementations can include one or more of the following features. The pressure relief valve can comprise an umbrella valve. The gas inlet valve can comprise an elastomeric duckbill valve and a fitting configured to receive a gas delivery device. Furthermore, the fitting can comprise a portion configured to actuate a pressure delivery device.

The container body can comprise a double walled metal vessel. In some cases, the container body can have a volume of less than 3 liters. For example, the container may be a "growler" or other vessel having a volume of from about 0.9 to 2 liters.

In another embodiment, the beverage storage and dispensing system can comprise a wire bail closure system. Furthermore, the closure system can comprise a pair of wire bails configured to toggle to a closed position in which the bails apply a downward force to the lid.

The invention also features methods of using the systems described herein to store, transport and dispense beverages, e.g., carbonated beverages.

DETAILED DESCRIPTION

The present disclosure relates generally to pressurized beverage storage systems. In some implementations, the beverage storage systems described herein include a container comprising a double-walled vessel constructed of stainless steel, a handle for transportation and manipulation of the container, a lid designed to be removably attached to the container, and a closure system designed to provide a pressure-tight engagement between the lid and the rim of the container. Preferably, all components of the system that come into contact with the beverage are formed of food-grade materials, e.g., stainless steel, silicone, TYGON® polymer, and the like.

Figure 1:
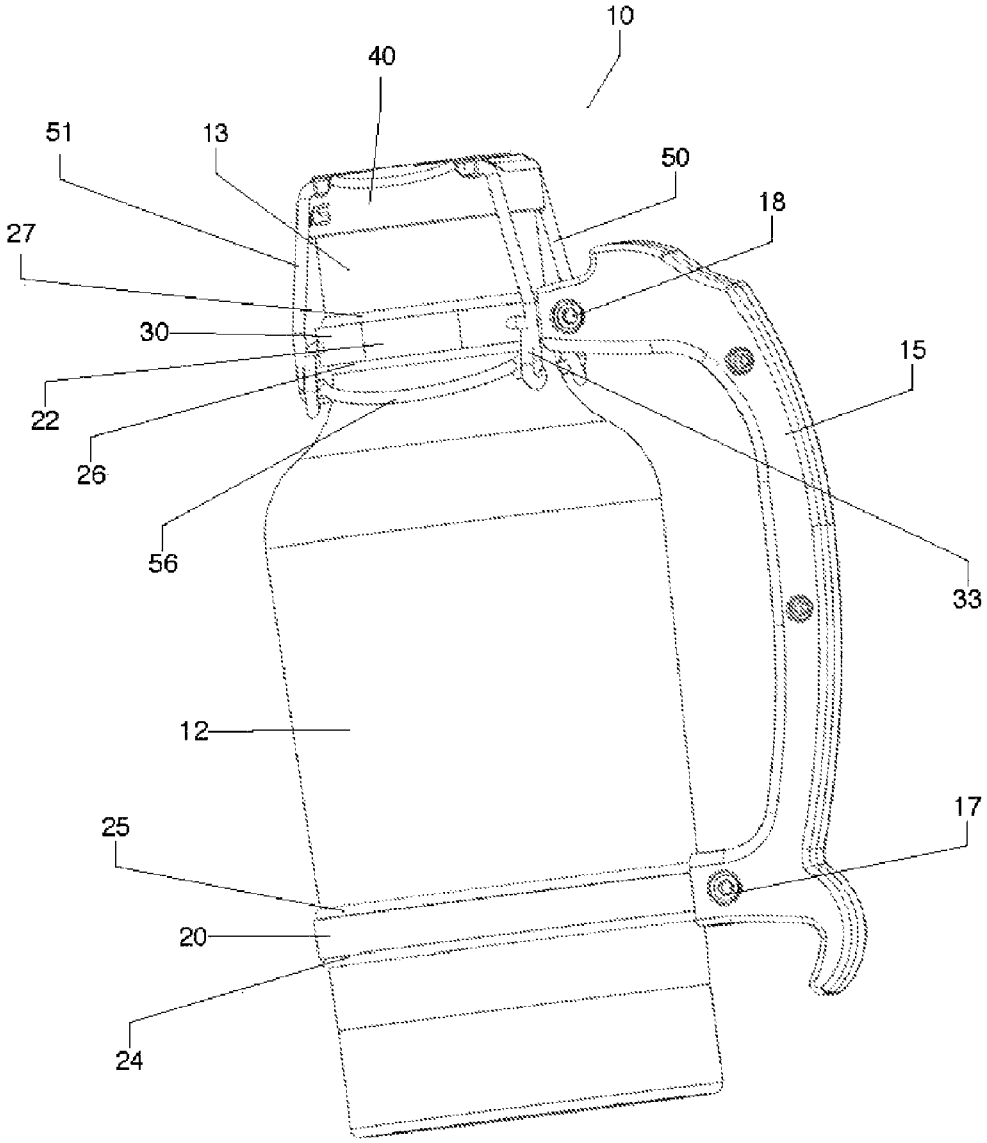
FIG. 1 is a perspective view of a pressurized beverage storage system according to one implementation, with the lid in a closed position.

Referring to FIG. 1, in one implementation a beverage storage system 10 includes a container 12, a handle 15, a lid 40, and a closure system that includes a pair of wire bails 50 and 51 disposed on either side of the lid in an over-center configuration. This closure system, and the manner in which it provides pressure-tight sealing, will be discussed further below.

Figure 3:
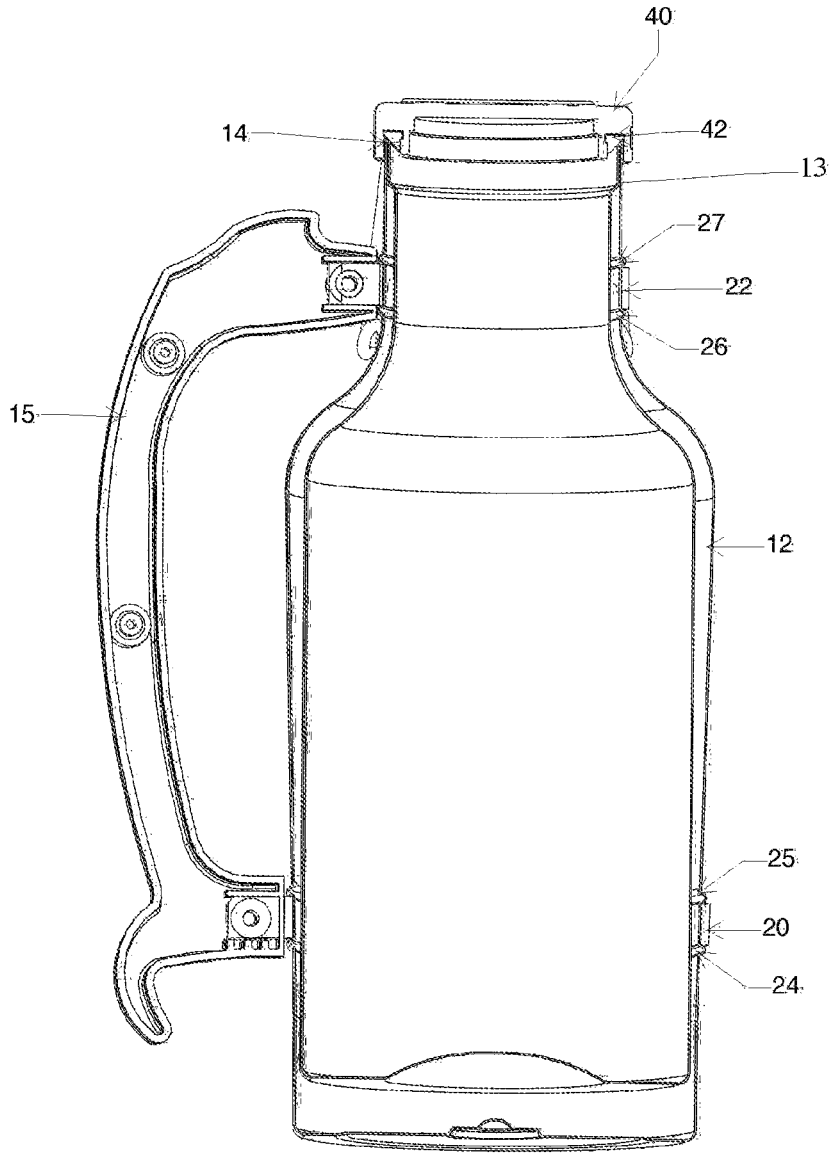
FIG. 3 is a sectional view of the system shown in FIG. 1.

As can be seen in FIG. 3, the container 12 is a double-walled, vacuum-sealed vessel, which is preferably constructed of food-grade stainless steel. The double wall provides a chamber that can be evacuated creating a vacuum. The vacuum provides temperature insulation for liquids held in the container 12. The container 12 is designed with a flat bottom so that it can securely rest on a surface without tipping. The container 12 has an upper section that is tapered, tapering through a shoulder to a wide-mouthed neck 13. The neck terminates at a rim 14 (FIGS. 4 and 5) which, due to the double-walled construction, is in the form of a bend rather than a flat surface. The container 12 preferably has a volume of about 30 to 70 ounces, for example the container may be a 64 ounce or 2 liter "growler" container.

The handle 15 is constructed of a rigid material, e.g. metal, wood or plastic, and is sufficiently strong to allow for manipulation of the container 12 when full of liquid. The handle 15 is connected to the container 12 at the neck 13 by band 22 and near the base by band 20 that encircle the container 12. The bands 20, 22 are connected to the handle 15 by nut-bolt interaction or similar at attachment points 17 and 18 (FIG. 1). The bands 20, 22 are constructed of metal that is sufficiently strong to prevent deflection or deformation of the bands when under load, e.g. when manipulating the container 12. Band retention features 24, 25, 26, 27, are configured above and below the bands 20, 22. The band retention features 24, 25, 26, 27, are raised (embossed) rings which protrude from the surface of the container 12 and are configured to minimize or eliminate slippage of the bands when the container is under load, e.g. during transportation or while pouring. Minimizing slippage is important not only for safety and durability, but also to maintain the correct positioning of the upper band 22 on the neck for proper over-center closing of the bails and thus pressure-tight sealing of the lid.

Figure 2:
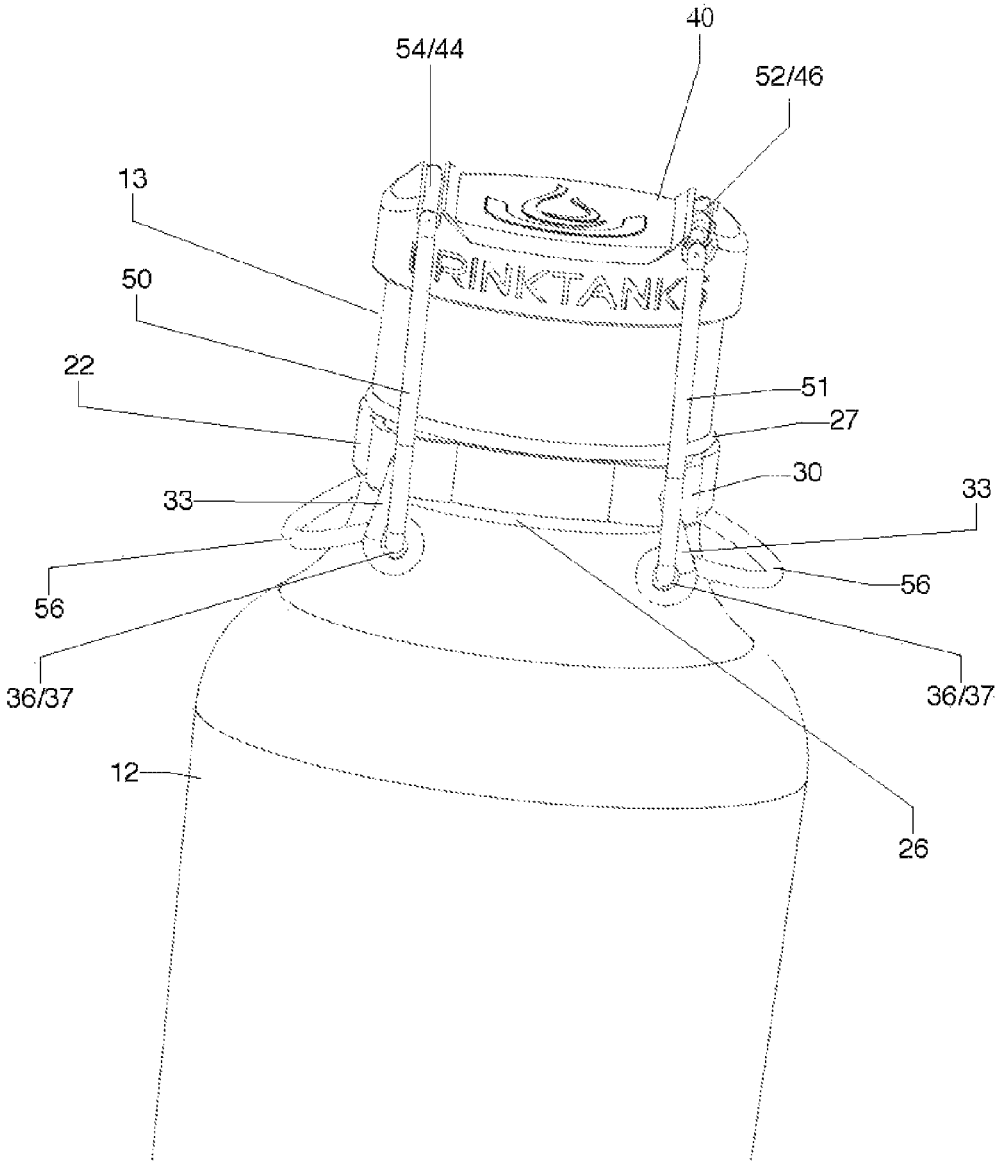
FIG. 2 is a partial perspective view of the system with the lid in the closed position, taken from another angle.
Figure 6:
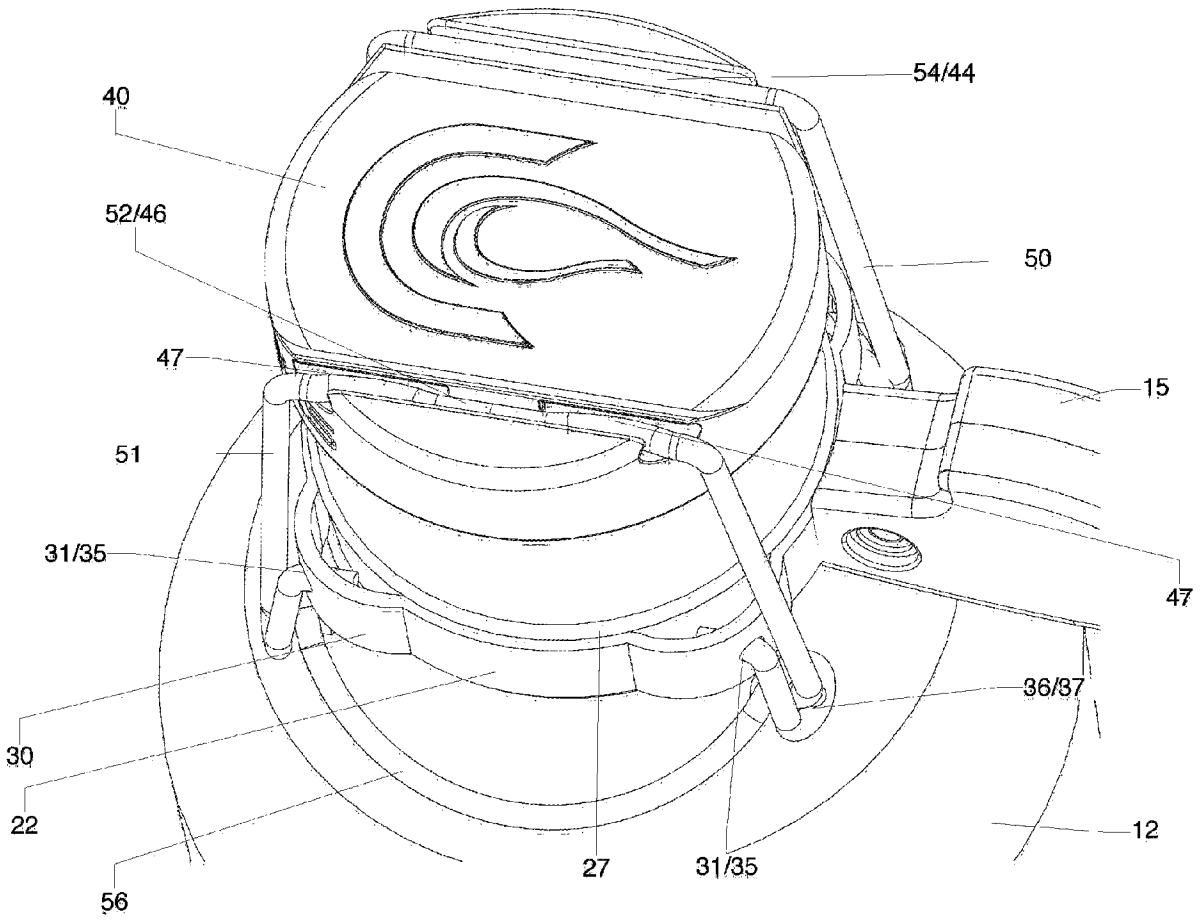
FIG. 6 is a top perspective view of the system with the lid in the closed position.
Figure 7:
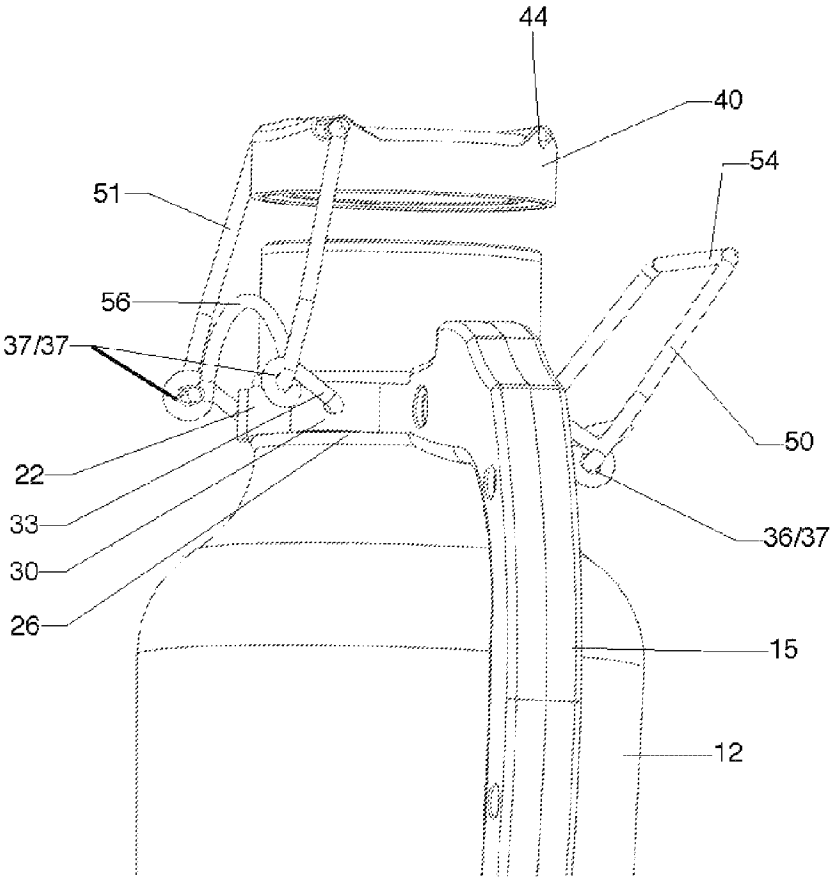
FIG. 7 is a perspective view of the system with one bail open and the lid lifted away from the rim.
Figure 8:
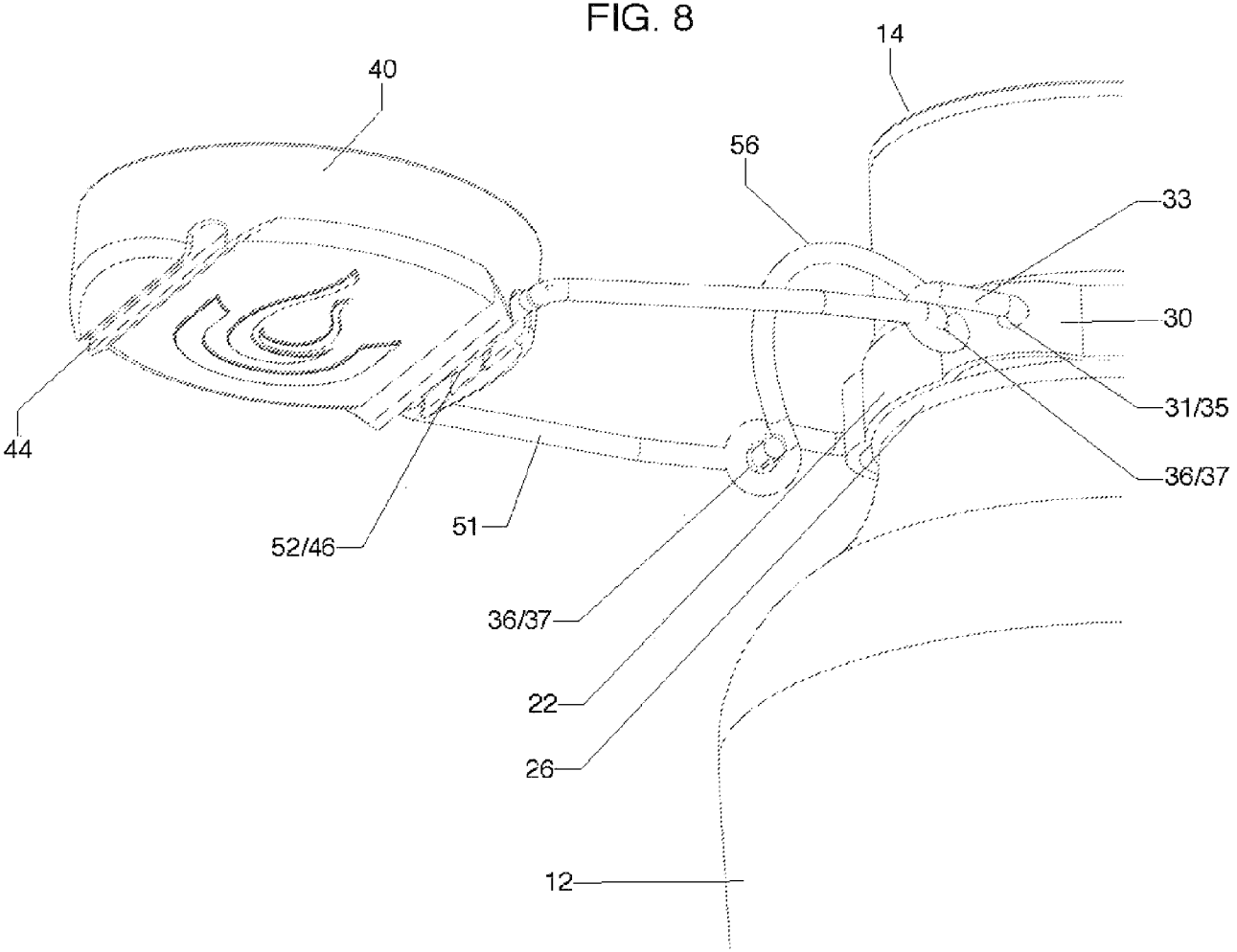
FIG. 8 is a perspective view of the system with one bail open and the lid swung back on the bail, out of the way of the mouth of the container.
Figure 9:
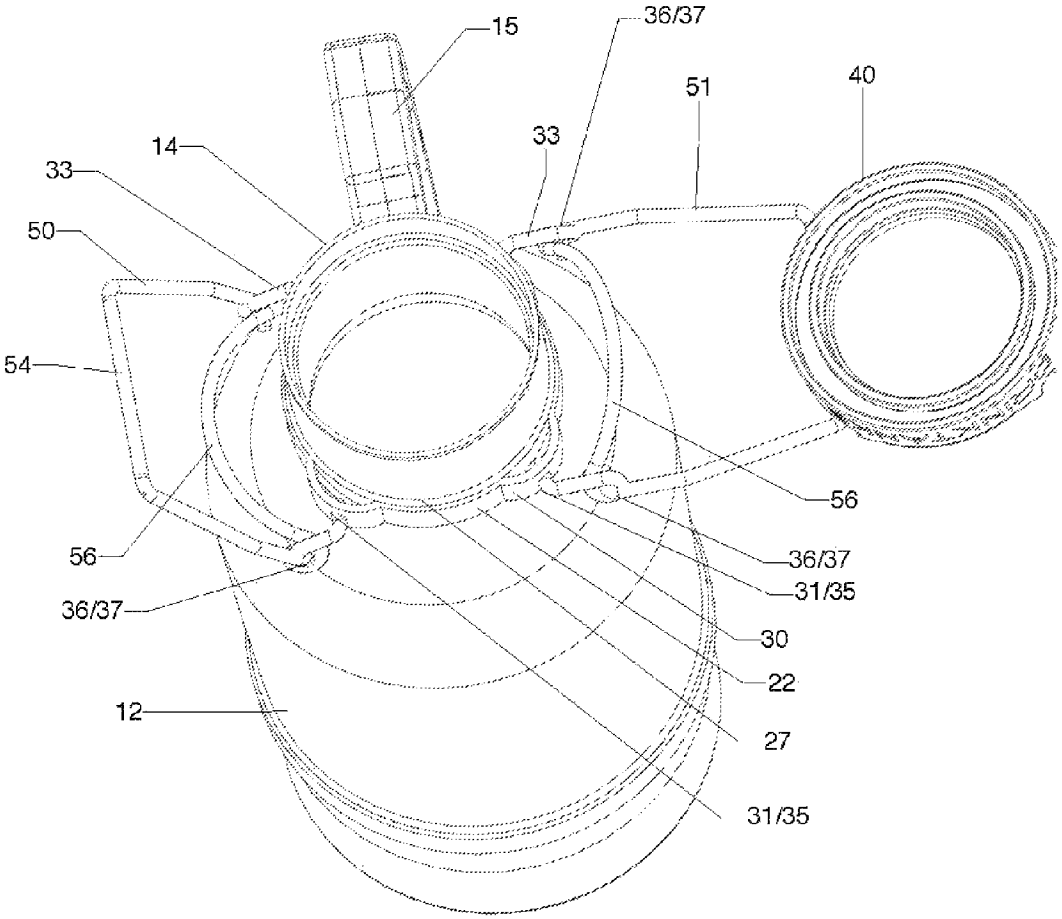
FIG. 9 is a top, perspective view of the device with the lid in the position shown in FIG. 8.

Referring to FIGS. 1 and 2, band 22 has four raised areas 30. Each raised area 30 provides a space between the band 22 and the outer wall of container 12 and includes an aperture 31 (FIGS. 6, 8, 9). Apertures 31 are configured to receive legs 33 of the latch portions 56 of the bails into the space behind the raised area. Apertures 31 thus serve as an attachment and pivoting point 35 for legs 33 which are integrally formed with the latch portions 56 of the bails. Each latch portion 56 can be pivoted by a user between an upward-facing open position (FIG. 7), and a downward-facing locked position (FIG. 2) in which it is generally flush against the neck 13. A pivot point 36 for bails 50, 51 is defined by a loop 37 between the latch portion 56 and legs 33 (FIGS. 2, 7, 8).

The outer surface of the lid 40 includes two channels 44, 46 that are configured to receive bails 50, 51. In the locked position, lid retention portions 52 and 54 of bails 50 and 51 are received in the channels 44 and 46, and each retention portion applies an over-center force to the lid 40 providing a downward force against the rim 14 of the container 12. This over-center engagement provides sufficient hold-down force to resist the internal pressure of the container and maintain the lid in place with an airtight seal. This over-center closing results from the relationship of the length of the vertical portions of bails 50 and 51 to the distance between the apertures 31 and the channels 44 and 46, making it important that the band 22 stay securely in place as discussed above. The length of the bails 50, 51 in combination with the length of legs 33 dictates the amount of lift of the lid and the amount of compressive force on the lid. If the vertical portions of bails 50, 51 are too long and/or the legs 33 are too short, there will not be sufficient tension in the closed position to compress the lid to provide an air-tight seal. The amount of force required to toggle the vertical portions of the bails 50, 51 over center is determined by the radius of curvature of the latch portions 56, with a longer radius providing more leverage for closing the bails.

Figure 4:
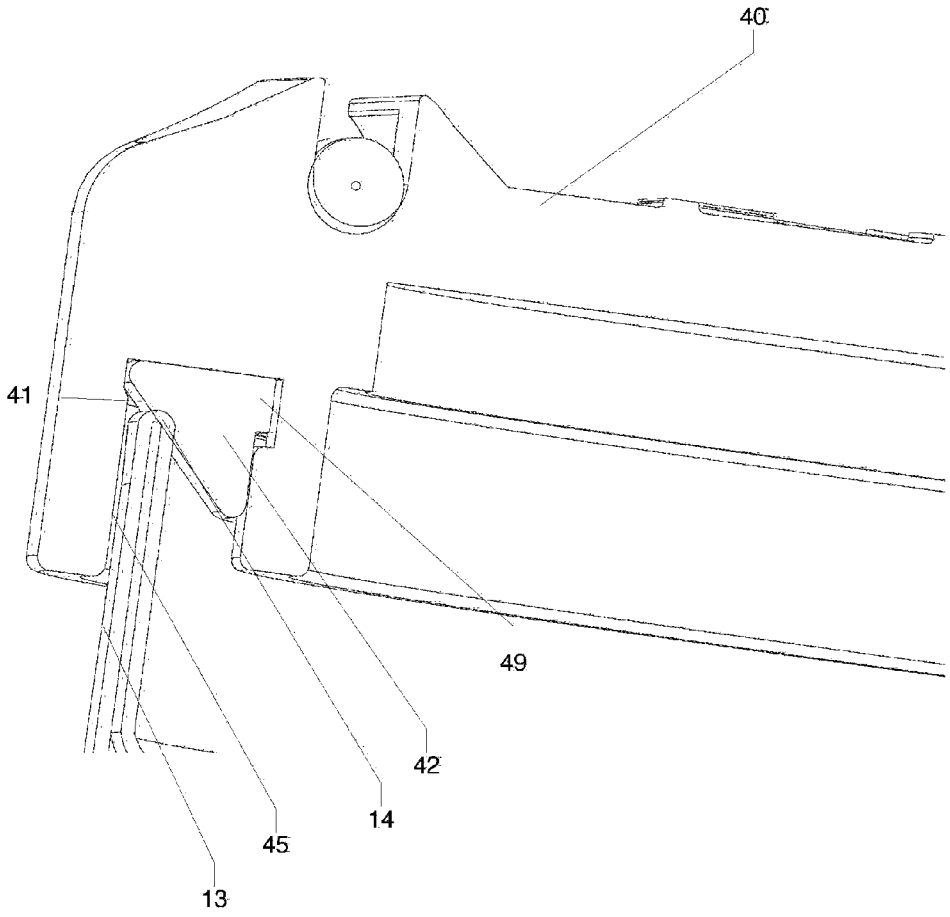
FIG. 4 is an enlarged, detail cross-sectional view of the lip-seal-lid interaction in the system shown in FIG. 1.

When the bails are closed, the positioning of the two bails on either side of the lid allows a uniform force to be applied by the beveled surface of the seal 42 to the lip of the container 14 creating an air-tight seal (FIG. 4). The two-bail arrangement also prevents the lid from flying off when the closure system is opened, as could occur with a single bail when the contents are under pressure. In some implementations, the bails are constructed to withstand an internal pressure of up to about 35 psi without bending. For example, the bails may be constructed of 316L stainless steel wire, and may have a diameter of at least 3 mm, e.g. 3.5 mm. Preferably, the bails are constructed of a material that has a sufficiently low modulus of elasticity to deform elastically when placed under tension by the over center closing of the bail. This characteristic enhances the performance of the closure mechanism because the tension in the stretched wire increases the pressure applied by the bail to the lid.

Figure 5:
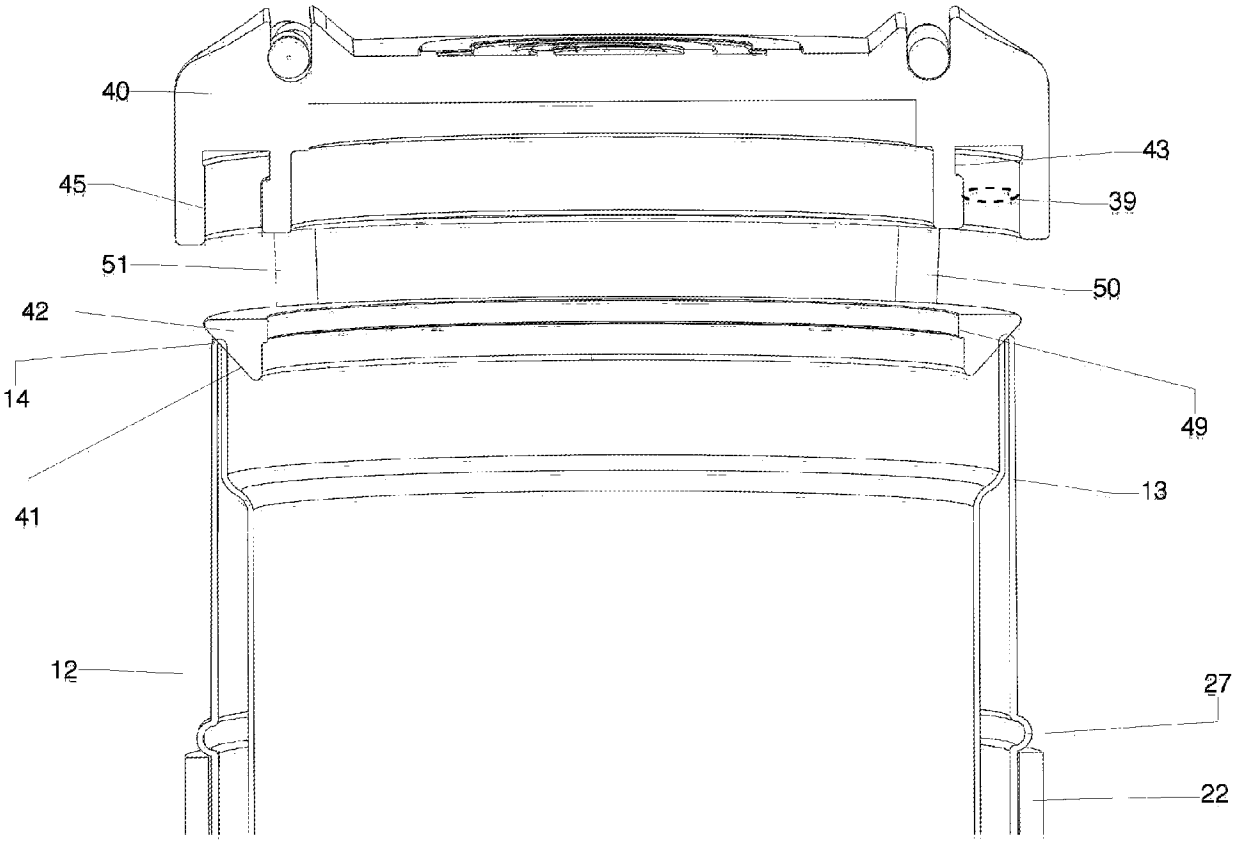
FIG. 5 is an exploded, sectional view of the lid, seal and upper aspect of the container.

The pressure-tight engagement between the lid and the rim is enhanced by the construction of the underside of the lid. Referring to FIGS. 3-5, the lid 40 includes a channel 39 (FIG. 5) that is dimensioned to receive the rim 14. Within the channel is a recess 43, which receives and retains an annular seal 42. The seal 42 is generally triangular in cross-section but includes a retention portion 49 that is dimensioned to fit into the recess 43. As shown in FIG. 4, the beveled surface 41 of the seal 42 allows the lid to seal positively against the non-flat surface of rim 14. The seal 42 is a preferably formed of a food-grade elastomer, e.g. food-grade silicone, of durometer hardness 45 to 55 Shore A, e.g. 50 Shore A. The inner sidewall 45 of the channel 39 also contributes to the security of the seal, by extending downwardly along the outer surface of neck 13 adjacent the rim and thereby holding the rim 14 against beveled surface 41 of the seal 42.

Figure 10:
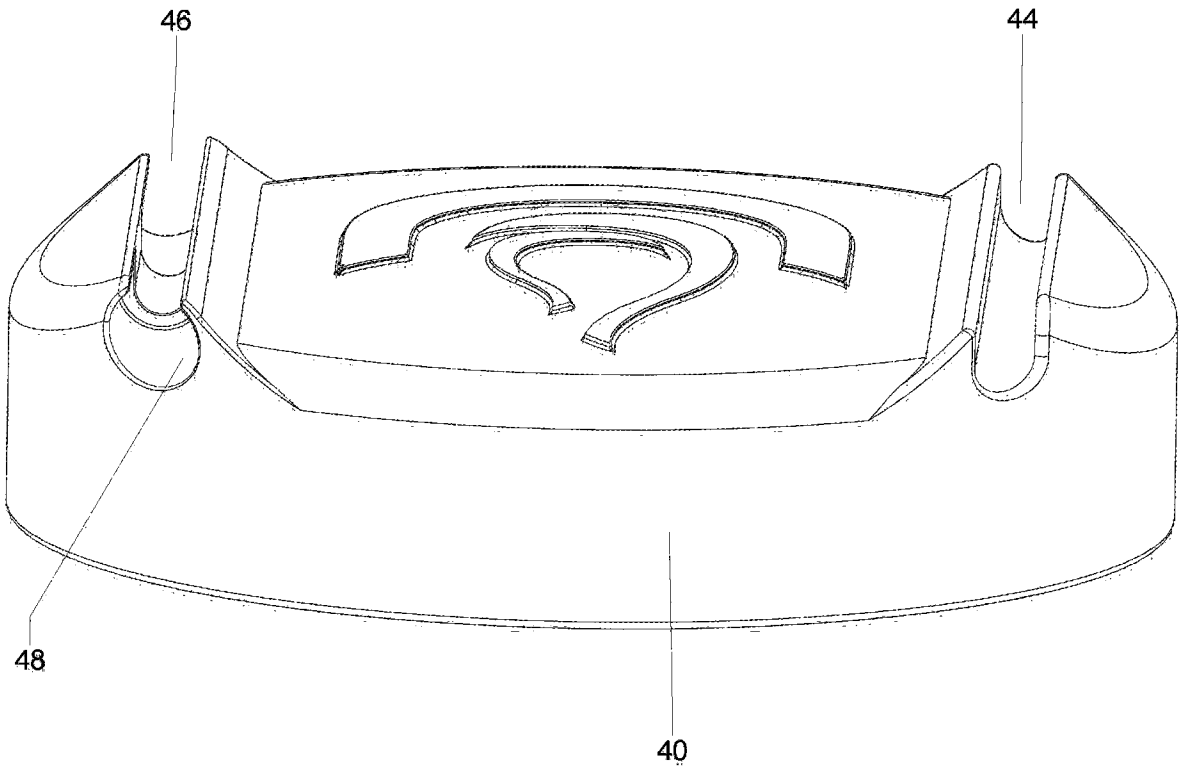
FIG. 10 is an enlarged, partial, perspective view of the retention channel of the lid.
Figure 11:
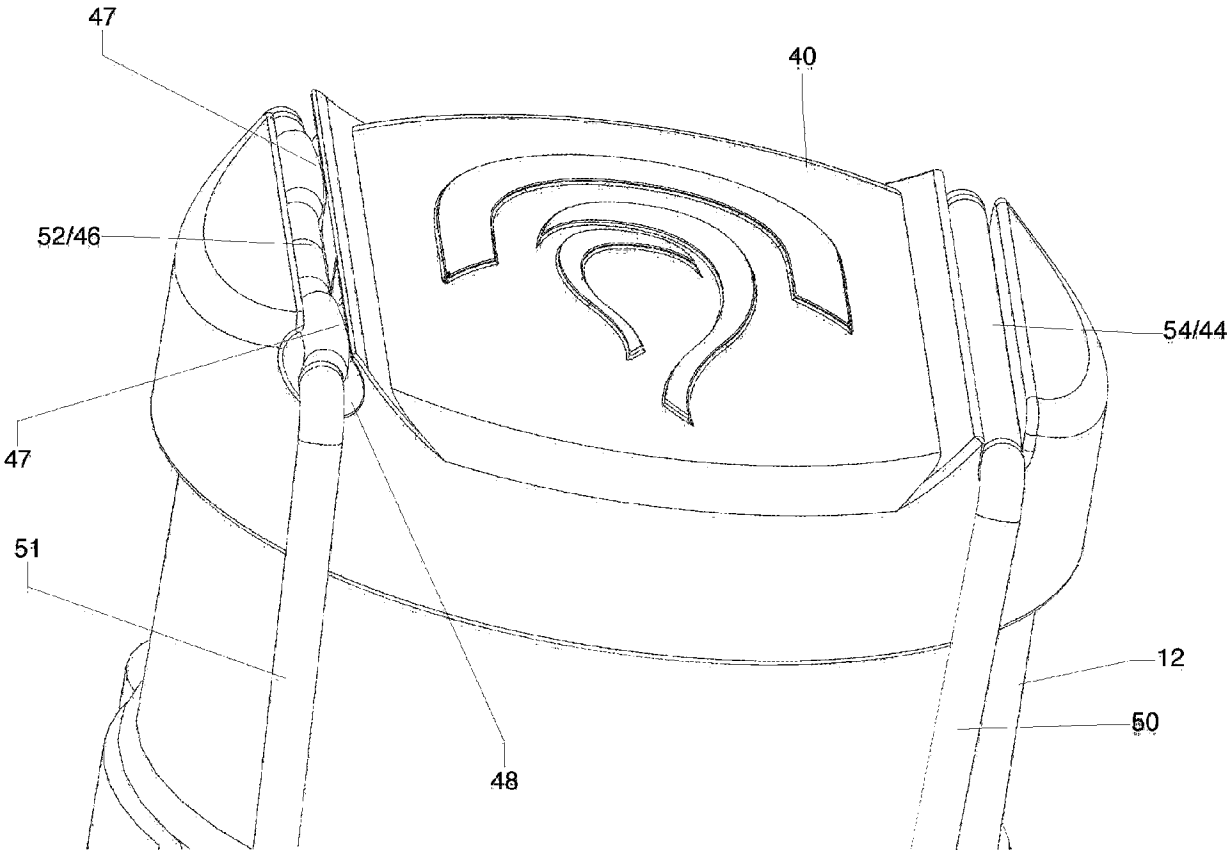
FIG. 11 is an enlarged, partial, perspective view of the retention channel of the lid with the retention bail engaged.

Referring to FIGS. 6, 7, 8, and 9, the lid 40 is opened by toggling latch portions 56 upwards from the locked, down position (FIG. 6). When the latch portions 56 are in open position (FIG. 7), the lid 40 can be released and pivots away from the container opening (FIG. 8). The length of the vertical portions of the bails 50, 51 is preferably sufficient to allow the lid to easily swing past the rim 14 during opening. Channel 46 (FIGS. 10, 11) features semi-eliptoid, undercut area 48 designed to receive a complementary shaped, arcuate section 47 of lid retention portion 52 of bail 51. When the container is closed, section 47 extends in a similar plane as the lid. As the lid 40 rotates away from the container opening, arcuate section 47 received into undercut area 48. The keyed engagement between the complementary surfaces serves to retain the lid 40 when the container 12 is open (FIGS. 8, 9). The lid 40 may be removed from bail 51, e.g. during cleaning or refitting, by appropriately aligning the retention portion 52 with channel 46. If desired, similar features may be provided on the other bail, so that the lid will be retained in place regardless of which side of the closure is opened first. Also, other types of retention features may be included in the channel, for example other areas may be undercut and/or of reduced diameter.

Figure 12:
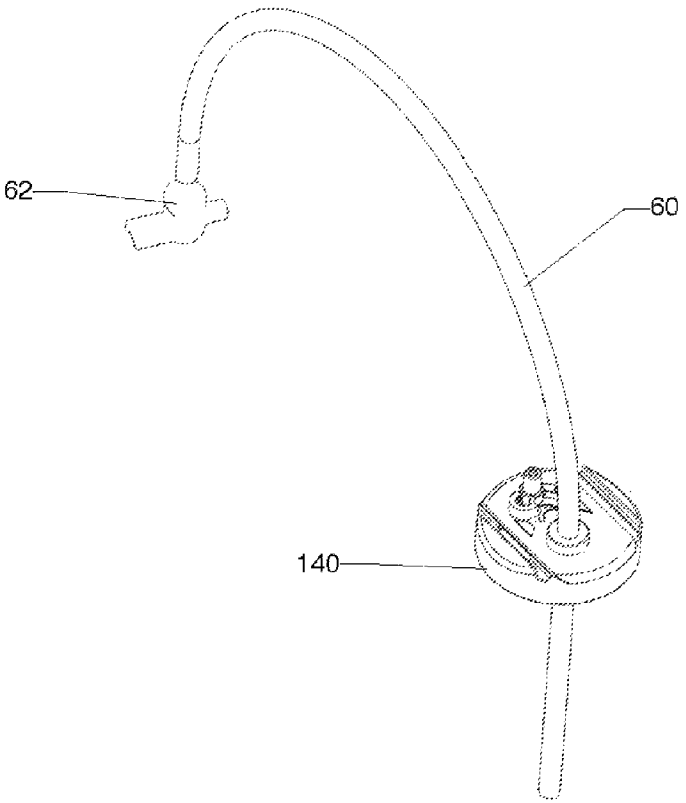
FIG. 12 is a perspective view of an alternate embodiment of the lid with repressurizing and dispensing devices.
Figure 13:
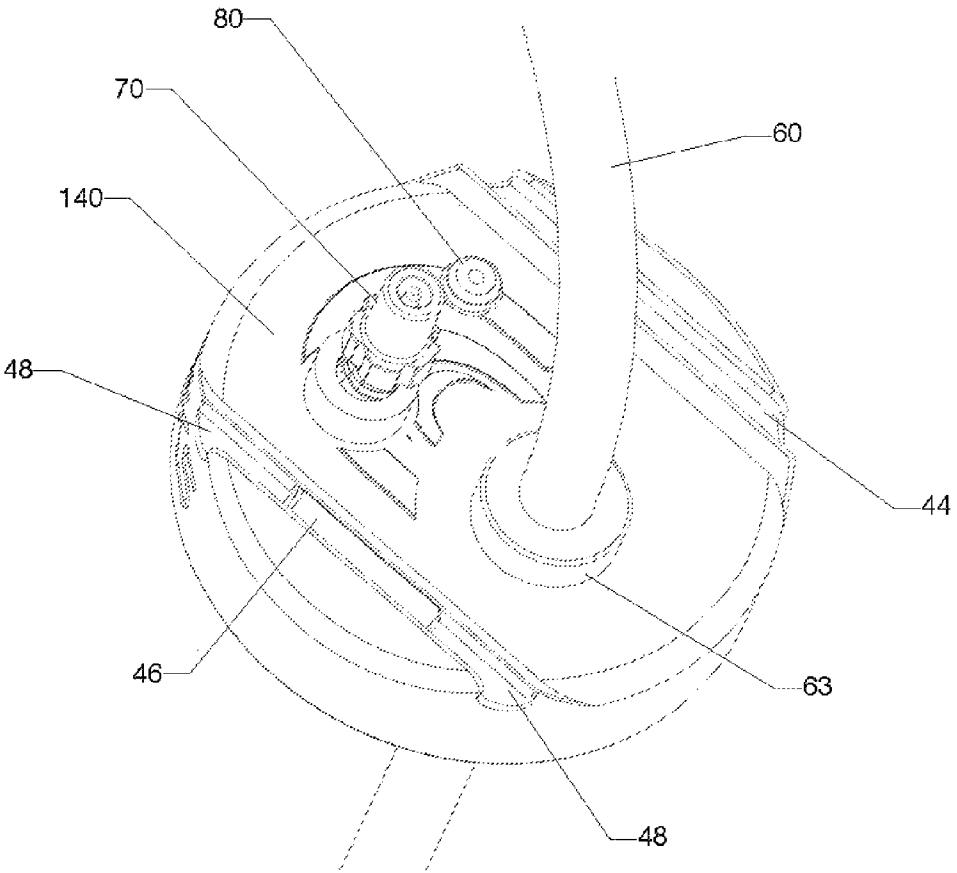
FIG. 13 is an enlarged, partial perspective view of the lid shown in FIG. 12.
Figure 14:
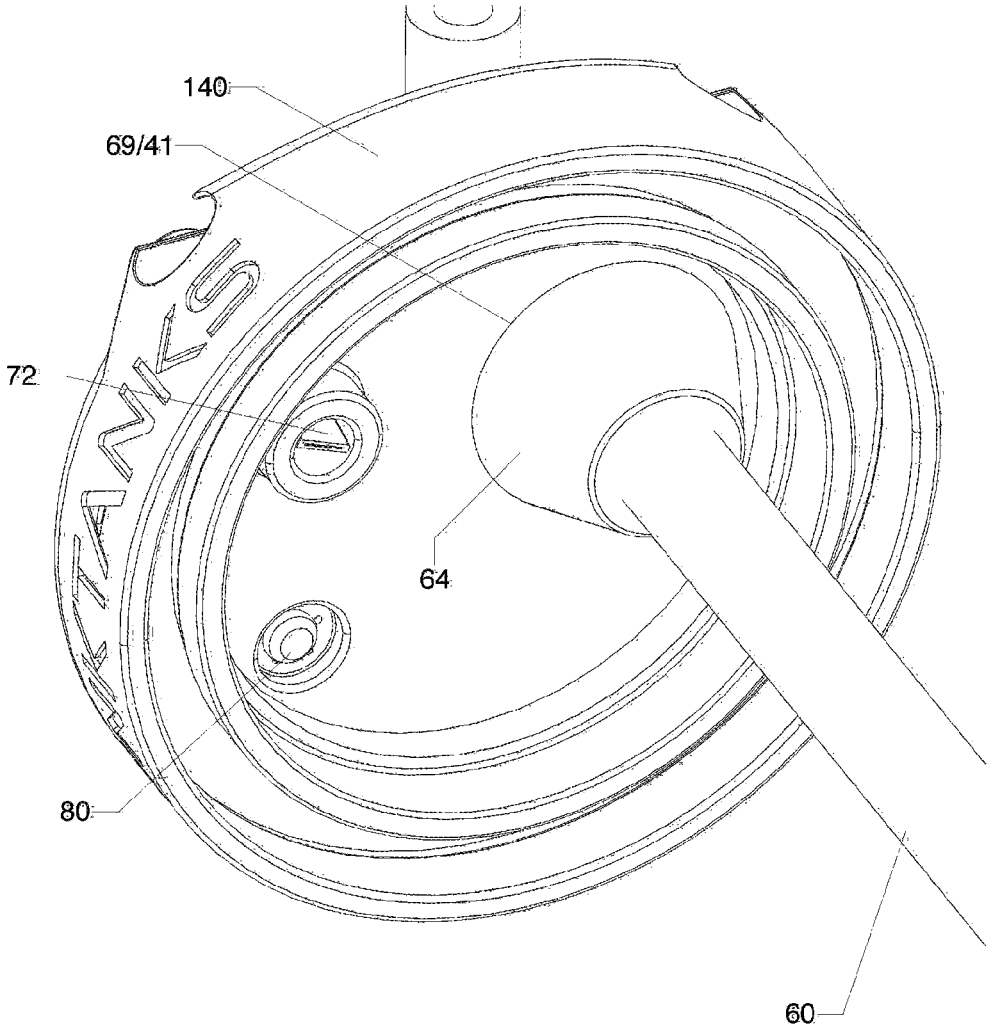
FIG. 14 is a perspective view of the underside of the lid shown in FIG. 12.

While the closure system described above allows pressure to be retained in the container, it does not allow the user to add a gas to further pressurize the contents of the container. Referring to FIGS. 12, 13 and 14, an alternate lid embodiment includes features that allow the user to pressurize the system and to easily dispense the contents of the container under pressure. In addition to providing a means to dispense liquid from the container, pressurizing the system also aids in preserving the beverage in the container and preventing it from losing its carbonation.

Pressurization is achieved by adding a gas to the container, while the lid 140 is sealed in its closed position, via pressure port 70. The pressure port 70 may be, for example, any standard pressurization valve, e.g. a Schrader or Presta valve or any other type of pressurization valve. However, in preferred embodiments the pressure port 70 is an elastomeric duckbill valve (as shown from below in FIGS. 14, 15) that deforms to an open position allowing one-way passage of gas into the container. The duckbill valve 72 is configured to naturally return to a closed position when gas is not passing through it. The strength of seal of the duckbill valve 72 is further increased when the beverage system is closed and under pressure because the external pressure in the headspace of the container urges the duckbill towards its closed position. The duckbill valve 72 is secured in place by a pressure inlet fitting 74 which is removably secured in place, e.g. by threads or barbs. In the embodiment shown in FIG. 15, the pressure inlet fitting 74 includes a pin 76 that is configured to allow gas to be injected into the closed beverage system using a standard pressure inlet system, e.g. a Schrader fitting. The removability of the pressure inlet fitting 74 allows the user to easily replace or interchange the fitting as needed, and also clean or replace the duckbill valve 72.

The lid 140 is also configured with a pressure relief valve 80. The relief valve is designed to release excess pressure from the closed container, thereby minimizing the possibility of explosion or deformation of the container due to over-pressurization. In preferred embodiments the relief valve is a miniature elastomeric umbrella valve having an "umbrella" portion that pops up to relieve pressure and resets itself to a closed (lowered) position when pressure returns to a predetermined value. Such valves are commercially available, for example, from Minivalve Inc., Cleveland, Ohio. Preferred valves are calibrated to open when an internal pressure of from about 8 to 35 psi is reached, e.g., from about 10 to 15 psi. It is generally preferred that pressure be released before an internal pressure is reached that would deform the bails. Additionally, the relief valve 80 is designed to be removable for cleaning or replacement.

Figure 15:
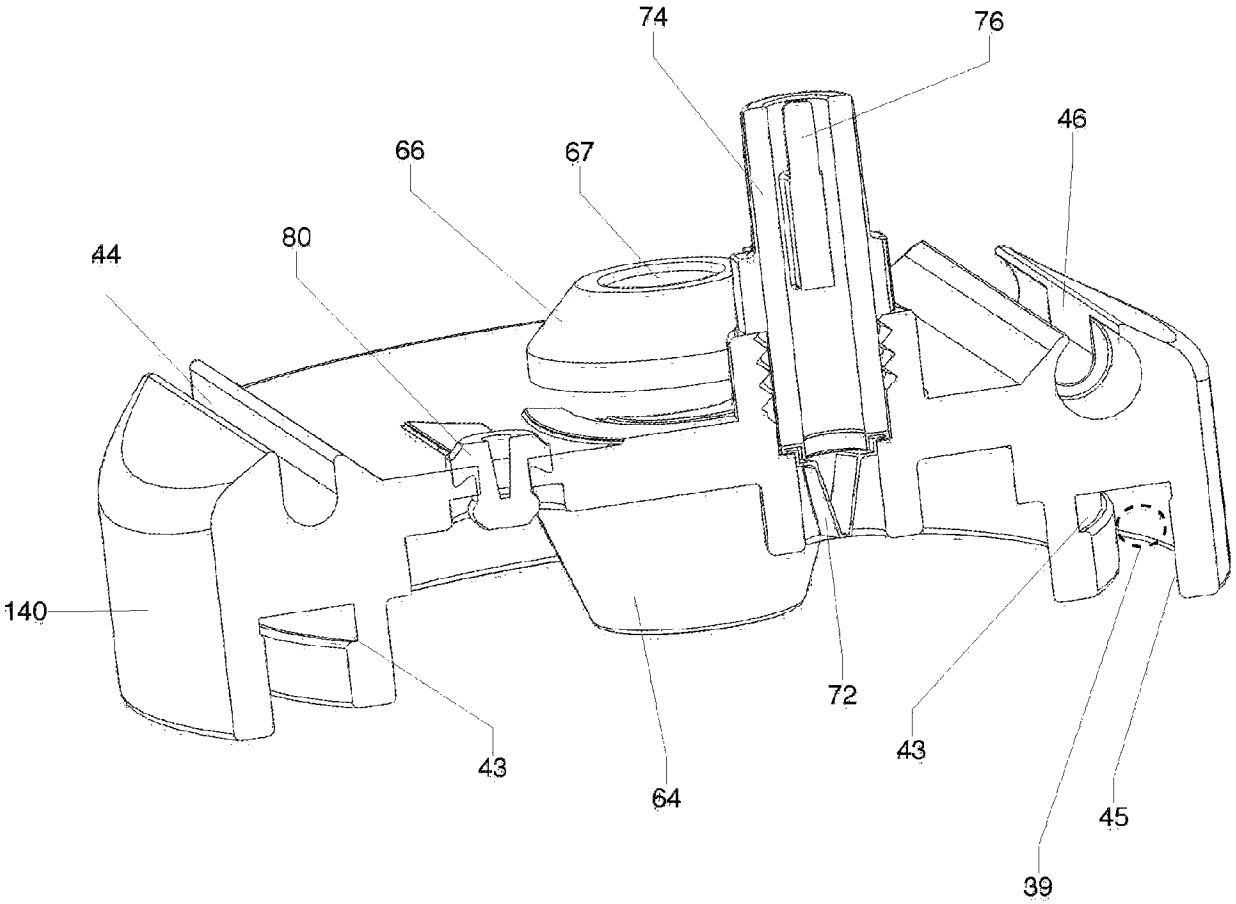
FIG. 15 is a sectional, perspective view of the alternate embodiment of the lid.
Figure 16:
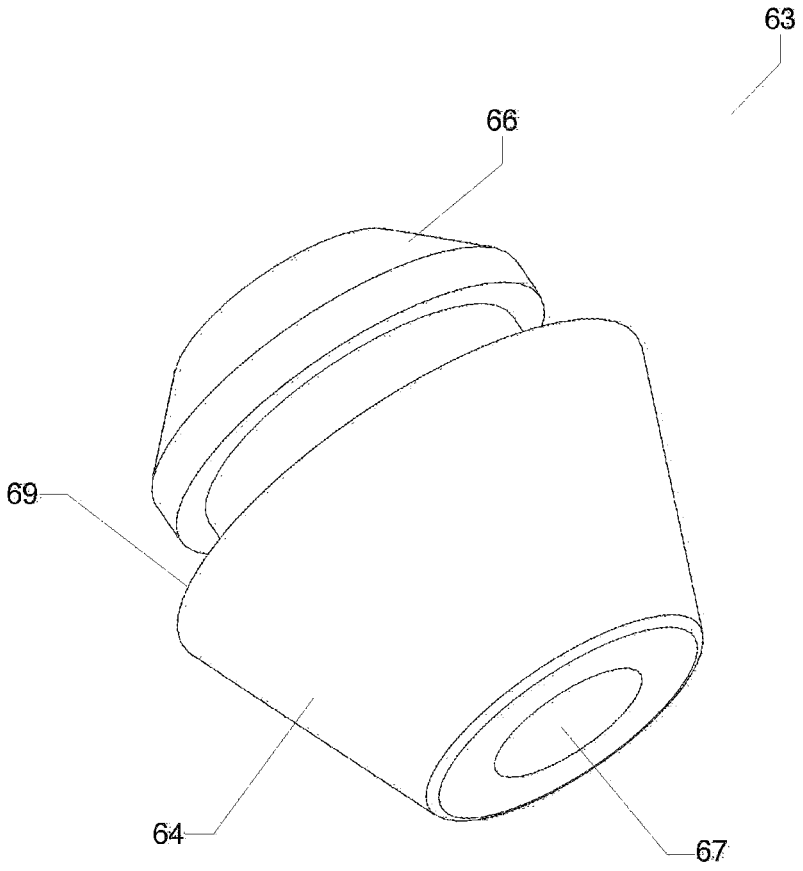
FIG. 16 is a perspective view of the conduit seal.
Figure 17:
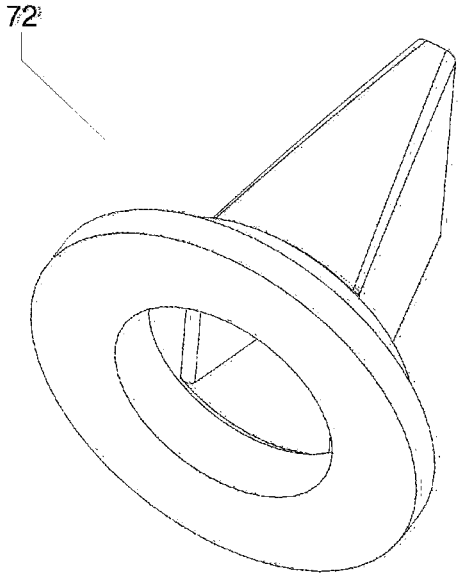
FIG. 17 is a perspective view of the duckbill valve.

Referring to FIGS. 13, 14, 15, liquid is dispensed through conduit 60 via spigot 62. The conduit 60 passes through the lid 140 via port 64. Conduit seal 63 provides a press-fit engagement with the outer surface of the conduit. Port 64 allows a single length of conduit to be used (rather than a segment above the lid and a separate segment below the lid), and permits the conduit to be easily removed from the lid for cleaning or replacement. The conduit may be, for example, TYGON® polymer tubing or other food-grade polymer tubing. Conduit seal 63 is designed to be replaceable. Beveled edge 66 aids assembly of conduit seal 63 in port 64 of the lid 140 by allowing the upper portion of the conduit seal 63 to more easily pass through the lid. Conduit seal 63 is preferably formed of a food-grade elastomer, e.g. food-grade silicone, with Durometer hardness 45 to 55 Shore A, e.g. 50 Shore A. Conduit seal 63 has an inner passage way 67 with a diameter that is slightly less than the outer diameter of the conduit 60 ensuring an air tight seal which is enhanced when the beverage system is under pressure, e.g. when storing or dispensing a liquid via the spigot. Surface 69 of the conduit seal 63 is sufficiently large to create an air-tight seal with a corresponding surface of the inner surface 41 of the lid. The corresponding areas of the lid where the seal makes contact should generally have very smooth and flat surface finishes. The seal is designed and dimensioned such that it has a consistent surface contact on the underside of the lid and has sufficient surface area on the underside portion so that the pressure impinging on the conduit seal from the inside of the vessel presses the seal against the lid surface.

OTHER EMBODIMENTS

A number of embodiments have been described. Nevertheless, it will be understood that various modifications may be made without departing from the spirit and scope of the disclosure.

For example, the band retention features (FIG. 1) 24, 25, 26, 27, can have any desired geometry that will minimize or eliminate slippage of the bands 20, 22. For example, the raised features described above can be replaced by recessed features, e.g., recessed rings dimensioned to receive the bands. As another example, the circumferential raised rings may be replaced by discrete raised features, e.g., buttons or other protrusions, disposed at intervals around the circumference of the container. In some implementations, the retention features 24, 25 for the lower band 20 may be omitted, or all retention features may be omitted if friction between the inner surface of the bands and outer surface of the container is sufficient to prevent slippage.

Moreover, the features described above can be used with larger or smaller containers, and in some cases may be used with containers of materials other than double-walled stainless steel, e.g., glass or other rigid materials.

The features described herein can be used with other types of closure systems. For example, the pressurization and dispensing features and/or the beveled seal can be used with threaded lids or lids with other closure features.

In other embodiments, the features described above (e.g., the pressurization and dispensing features) could be combined with an alternative type of closure mechanism. For example, the bails or a similar closure mechanism could be pivotably attached to the lid rather than to the container. In this case, the bails could be dimensioned to engage a lip, ledge or other retention feature on the container, handle, band or any combination thereof, with the resulting interaction creating a pressure-tight seal when the lid is closed. As another example, a twist or cam-type retention feature could be integrally formed into the lid and/or the neck of the container. Alternatively, the bail(s) could be dimensioned to rotate upward, remaining in and pivoting around the holes in the upper band, and snap into a latch on the lid. Another type of closure mechanism could feature spring-loaded or squeeze-type latches built into the lid or neck of the container that could be actuated with hand or finger pressure.

Another embodiment could feature a container that is insulated in another manner. For example, the chamber created by the double-wall could be filled with other insulative materials, such as foam or a gas.

Accordingly, other embodiments are within the scope of the following claims.

What is claimed is:

1. A beverage storage and dispensing system, the dispensing system comprising:

a container body comprising a double-walled, vacuum sealed metal vessel having a rim which has a non-planar surface formed by a bend in the metal, the bend defining the double-walled structure, a lid having a dispensing port, a pressure relief valve, and a gas inlet valve;

an annular elastomeric seal interposed between a bottom surface of the lid and the rim and configured to seal against the non-planar surface of the rim;

a tubular conduit configured to be sealingly retained in the dispensing port and extend above and below the lid; and a dispensing device at a distal end of the conduit.

2. The system of claim 1 wherein the pressure relief valve comprises an umbrella valve.

3. The system of claim 1 wherein the gas inlet valve comprises an elastomeric duckbill valve and a removable pressure inlet fitting configured to receive a gas delivery device.

4. The system of claim 3 wherein the fitting comprises a portion configured to actuate a pressure delivery device.

5. The system of claim 1 wherein the container body has a volume of less than 3 liters.

6. The system of claim 1 further comprising a wire bail closure system.

7. The system of claim 6 wherein the closure system comprises a pair of wire bails configured to toggle to a closed position in which the bails apply a downward force to the lid.

8. The system of claim 7 wherein, in the closed position, the wire bails latch over-center.

9. The system of claim 7 wherein the lid and at least one of the wire bails include cooperating features configured to retain the lid on the bail when the bail is in an open position.

10. The system of claim 9 wherein the cooperating features include a channel in an upper surface of the lid having an undercut region configured to retain a corresponding feature of the bail.

11. The system of claim 7 wherein the container body further includes a neck region and the system further comprises a band fixedly mounted on the neck region and configured for pivoting attachment of the bails.

12. The system of claim 1 wherein the elastomeric seal has a beveled surface configured for engagement with the non-planar surface.

13. The system of claim 1 wherein the seal is disposed in an annular channel in the bottom surface of the lid.

14. The system of claim 13 wherein the container body includes a generally cylindrical neck region and the channel includes a sidewall configured to abut an outer surface of the neck region.

15. The system of claim 1 further comprising a handle mounted on the container body.

16. The system of claim 15 wherein the handle is mounted on a band that extends around the container body, and the container body includes features for retaining the band in a fixed position on the container body.

17. The system of claim 16 wherein the container body includes a neck region and the band is fixedly mounted on the neck region and configured for pivoting attachment of a wire bail closure.

18. The system of claim 1 wherein the dispensing device comprises a spigot.

19. A beverage storage and dispensing system, the dispensing system comprising:

a container body, and a lid having a dispensing port, a pressure relief valve, and a gas inlet valve;

a wire bail closure system comprising a pair of wire bails configured to toggle to a closed position in which the bails apply a downward force to the lid;

a tubular conduit configured to be sealingly retained in the dispensing port and extend above and below the lid; and a dispensing device at a distal end of the conduit.

20. A beverage storage and dispensing system, the dispensing system comprising:

a container body comprising a double-walled, vacuum sealed metal vessel having a rim which has a non-planar surface formed by a bend in the metal, the bend defining the double-walled structure, a lid having a dispensing port, a pressure relief valve, and a gas inlet valve; and an annular elastomeric seal interposed between a bottom surface of the lid and the rim and configured to seal against the non-planar surface of the rim.

* * * * *